US006857374B2

(12) United States Patent
Novacek

(10) Patent No.: US 6,857,374 B2
(45) Date of Patent: Feb. 22, 2005

(54) GUIDEWAY AND VEHICLE FOR TRANSPORTATION SYSTEM

(76) Inventor: Milan Novacek, 14106 SE. 49th Pl., Bellevue, WA (US) 98006

( * ) Notice: Subject to any disclaimer, the term of this patent is extended or adjusted under 35 U.S.C. 154(b) by 0 days.

(21) Appl. No.: 10/325,645

(22) Filed: Dec. 19, 2002

(65) Prior Publication Data

US 2003/0140817 A1 Jul. 31, 2003

Related U.S. Application Data

(60) Provisional application No. 60/343,474, filed on Dec. 20, 2001.

(51) Int. Cl.[7] ..... E01B 25/06

(52) U.S. Cl. ..... 104/130.07; 104/119; 104/140

(58) Field of Search ..... 104/119, 120, 104/121, 140, 137, 242, 243, 245, 246, 139, 247, 130.01, 130.07; 105/145, 215

(56) References Cited

U.S. PATENT DOCUMENTS

| | | | | |
|---|---|---|---|---|
| 1,454,804 A | | 5/1923 | Wright | |
| 2,977,892 A | | 4/1961 | Ihmig | |
| 3,143,977 A | | 8/1964 | Deller | |
| 3,575,454 A | * | 4/1971 | Meeker | 293/127 |
| 4,068,598 A | | 1/1978 | Bardet | |
| 4,083,309 A | | 4/1978 | Gerard | |
| 4,132,175 A | * | 1/1979 | Miller et al. | 104/130.07 |
| 4,522,128 A | | 6/1985 | Anderson | |
| 4,658,731 A | * | 4/1987 | Schumann | 104/130.07 |
| 5,245,930 A | * | 9/1993 | Williams | 104/120 |
| 5,794,535 A | | 8/1998 | Pardes | |
| 6,095,054 A | | 8/2000 | Kawano et al. | |
| 6,371,032 B1 | * | 4/2002 | Graefer et al. | 105/141 |

FOREIGN PATENT DOCUMENTS

| | | | |
|---|---|---|---|
| DE | 907 061 C | | 3/1954 |
| DE | 21 63 825 A | | 6/1973 |
| DE | DT2163825 A1 | * | 6/1973 |
| DE | 24 29 887 A | | 1/1976 |
| DE | 197 25 644 A | | 12/1998 |
| FR | 1 223 603 A | | 6/1960 |

* cited by examiner

*Primary Examiner*—Frantz F. Jules
(74) *Attorney, Agent, or Firm*—Christensen O'Connor Johnson Kindness PLLC

(57) ABSTRACT

The guideway-based transportation system includes a guideway and a mating vehicle. The guideway includes a main guideway section that may branch at a branch point into two separate branch sections. The guideway has a suitable geometry to support and guide the vehicle at any speed reasonably associated with such a transportation system. The vehicle includes both support and guide wheels to support the weight of the vehicle and to maintain contact between the vehicle and the guideway as it moves along the guideway, and may optionally include a switching wheel assembly for switching the path of travel of the vehicle from the main guideway section to either of the branch sections.

19 Claims, 10 Drawing Sheets

GUIDEWAY AND VEHICLE FOR TRANSPORTATION SYSTEM

CROSS-REFERENCE TO RELATED APPLICATION

The present application claims the benefit of Provisional Patent Application No. 60/343,474, filed Dec. 20, 2001, the disclosure of which is incorporated herein by reference.

FIELD OF THE INVENTION

The invention relates to guideway-based transportation systems used to transport people or goods, and in particular to a guideway and mating vehicle for transporting people and/or goods.

BACKGROUND OF THE INVENTION

Guideway-based transportation systems have long been used to transport people or goods. One example is a Personal Rapid Transit System ("PRT"). These systems generally comprise a transit vehicle that is controlled to self-steer along a guideway track or roadway having surfaces designed to restrain the vehicle to the track. The vehicle generally includes a plurality of guide and support wheels designed to coupled the vehicle to the guideway.

The guideway commonly consists of a section of track. In some implementations, the track may be pivoted to switch selectively between a first roadway, and if desired, a second roadway. Drawbacks of these systems include increased cost and complexity of the switching track and the necessity for increased control, either human or computer, to ensure the track is switched to the proper position as each transit vehicle moves along the guideway.

Other guideway designs to be used in combination with transit vehicles have been implemented to replace the traditional switched guideway system; however, each of these systems retains many of the short-comings of the traditional systems while in some cases, creating new drawbacks. Such short-comings include overall cost and complexity of the system, inability of the system to travel at high speeds, and inability of the system to be used in all environments, particularly an outdoor environment. Accordingly, there remains a need for a guideway-based transportation system that is relatively simple to control, can be used for high-speed operation, can be used in any type of environment.

SUMMARY OF THE INVENTION

In accordance with an aspect of the present invention, a vehicle bogie is provided. The vehicle bogie, to which a passenger or freight holding structure is mounted, is matable during use with a transportation system guideway having a central raised platform and lateral side walls. The vehicle bogie includes a support frame and at least one support wheel rotatably connected to the support frame about a first rotational axis. The support wheel is adapted to contact a running surface of the central raised platform of the guideway for supporting the vehicle bogie on the guideway. The vehicle bogie also includes at least one guide wheel rotatably connected to the support frame about a second rotational axis. The guide wheel is spaced outward from the support wheel and adapted to contact a first lateral running surface of the lateral sidewall.

In accordance with another aspect of the present invention, a guideway of a transportation system is provided. The guideway includes a floor and a centrally disposed raised platform extending away from the floor. The platform defines a top running surface and two side switching surfaces. The guideway further includes at least one lateral side stabilizing wall spaced-apart from the raised platform and extending away from the floor. The stabilizing wall defines a substantially planar guide running surface.

In accordance with still another aspect of the present invention, a transportation system is provided. The transportation system comprises a guideway that includes a floor and a centrally disposed raised platform extending away from the floor. The platform defines a top running surface and two side switching surfaces. The guideway also includes at least one lateral side stabilizing wall spaced-apart from the raised platform and extending away from the floor. The stabilizing wall defines a substantially planar guide surface. The transportation system further includes a vehicle that includes a bogie having a support frame, at least one support wheel rotatably connected to the support frame that contacts the top running surface, at least one guide wheel rotatably connected to the support frame that contacts the guide surface, and a switching wheel assembly. The switching wheel assembly includes a main pivot arm and switch wheels carried at the ends of the main pivot arm, either one of the switch wheels engaging against one of the side switching surfaces.

In accordance with yet another aspect of the present invention, a guideway of a transportation system is provided. The guideway includes a first guideway section including a first floor, and a first centrally disposed raised platform extending away from the first floor. The first platform defines a first top running surface and two first side switching surfaces. The first guideway section further includes two first lateral side stabilizing walls extending away from the first floor on both sides of the first raised platform. The first stabilizing walls define substantially planar guide surfaces. The guideway further includes a second guideway section connected adjacent the first guideway section. The second guideway section includes a second floor connected to the first floor, and a second centrally disposed raised platform contiguously connected with the first centrally disposed raised platform. The second raised platform extends away from the second floor and defines a second top running surface and two second side switching surfaces. The second guideway section further includes a second side stabilizing wall extending away from the second floor on one side of the second raised platform. The second stabilizing wall defines a substantially planar guide surface. The first and second running surfaces and the first and second side switching surfaces are connected so as to form contiguously planar running surfaces.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

The present invention will now be described with reference to the accompanying drawings where like numerals correspond to like elements. The present invention is directed to a guideway and vehicle for transportation systems. Specifically, the present invention is directed to a vehicle and its cooperating guideway that can provide higher vehicle speeds and a more comfortable operation for passengers or freight. The present invention achieves the aforementioned attributes through unique vehicle wheel arrangements that engage cooperatingly designed guideways. The unique vehicle wheel arrangements may optionally include a switching wheel assembly when the vehicle is used with a guideway having branch sections.

Figure 1:
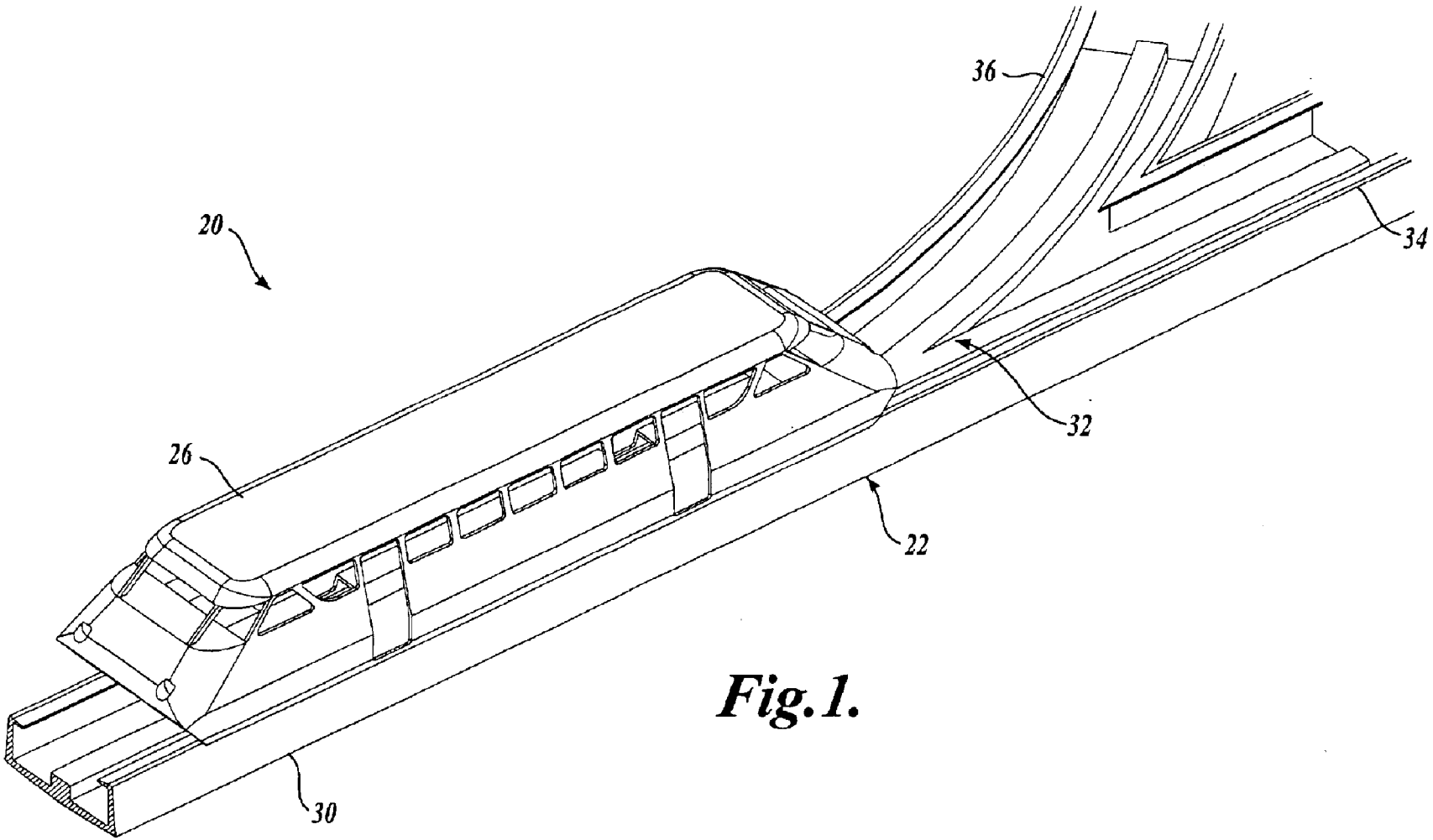
FIG. 1 is a perspective view of a transportation system formed in accordance with one embodiment of the present invention.

FIG. 1 illustrates a guideway-based transportation system 20 formed in accordance with one embodiment of the present invention. The guideway-based transportation system 20 includes a guideway 22 and a mating vehicle 26. The guideway 22 includes a main guideway section 30 that branches at a branch point 32 into two separate branch sections 34 and 36. The guideway 22 has a suitable geometry to support and guide the vehicle 26 at any speed reasonably associated with such a transportation system. The vehicle 26 includes both support and guide wheels (not shown) to support the weight of the vehicle 26 and to maintain contact between the vehicle 26 and the guideway 22 as it moves along the guideway, and may optionally include a switching wheel assembly (not shown) for switching the path of travel of the vehicle 26 from the main guideway section 30 to either of the branch sections 34 or 36.

Figure 2:
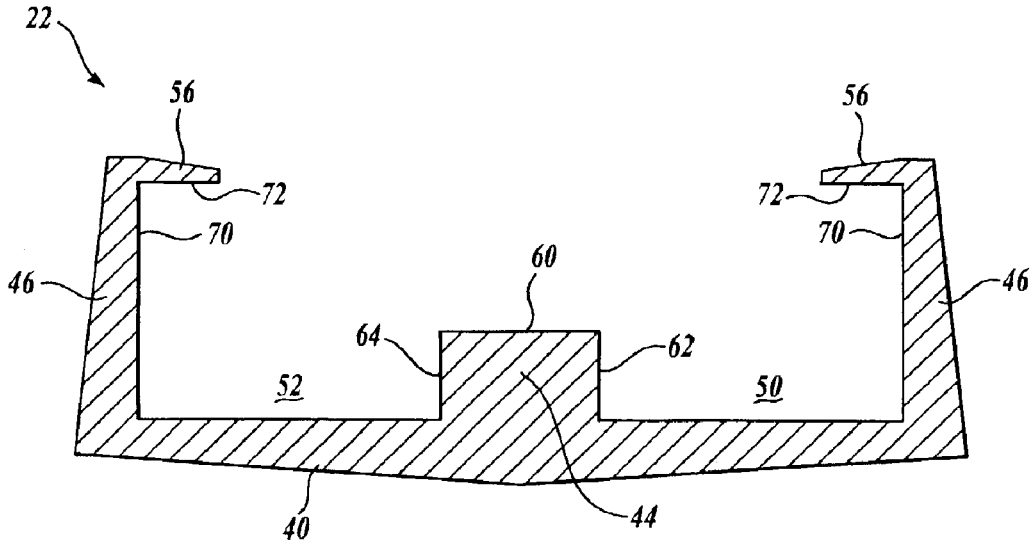
FIG. 2 is a cross-sectional view of an exemplary embodiment of the guideway utilized by the transportation system of FIG. 1.

Referring now to FIG. 2, there is shown in cross-section one exemplary embodiment of the guideway 22. The guideway 22 includes a floor 40 from which a central raised platform 44 is formed. Laterally spaced side stabilizing walls 46 are included, which extend upward from the floor 40 on either side of the central raised platform 44, thereby forming two bottom wells 50, 52 between the sides of the central raised platform 44 and the side stabilizing walls 46. At the upwardmost ends of the side stabilizing walls are flanges 56, which extend inward from the side stabilizing walls 46, substantially parallel with the floor 48. The central raised platform 44 of the guideway 22 forms a top surface 60 and two side switching surfaces 62 and 64. The top surface 60 generally supports the weight of the vehicle and the side switching surfaces 62 and 64 permit switching between the branch sections of the guideway 22 as the vehicle travels to its destination. The manner in which the top surface 60 supports the weight of the vehicle while the side switching surfaces 62 and 64 permit switching branch sections of the track will be described in more detail below. The guideway 22 may include other components, such as a support pillar (not shown), which can anchor the guideway and can elevate the guideway, if necessary.

The side stabilizing walls 46 form lateral, generally planar guide surfaces 70 that face inward toward the side switching surfaces 62 and 64 of the guideway 22. The guide surfaces 70 limit and thereby substantially control the side-to-side lateral movement of the vehicle and provide torsional stability. In the embodiment shown, the guide surfaces are substantially orthogonal to the top surface 60. However, it is contemplated that other orientations between the guide surfaces 70 and the top surface 60 are possible. The flanges 56 form generally planar torsional stabilizing surfaces 72 that face downwardly at the bottom wells 50 and 52, substantially orthogonal to the guide surfaces 70. The torsional stabilizing surfaces 72 provide torsional support for the vehicle when these forces are present.

Figure 10A:
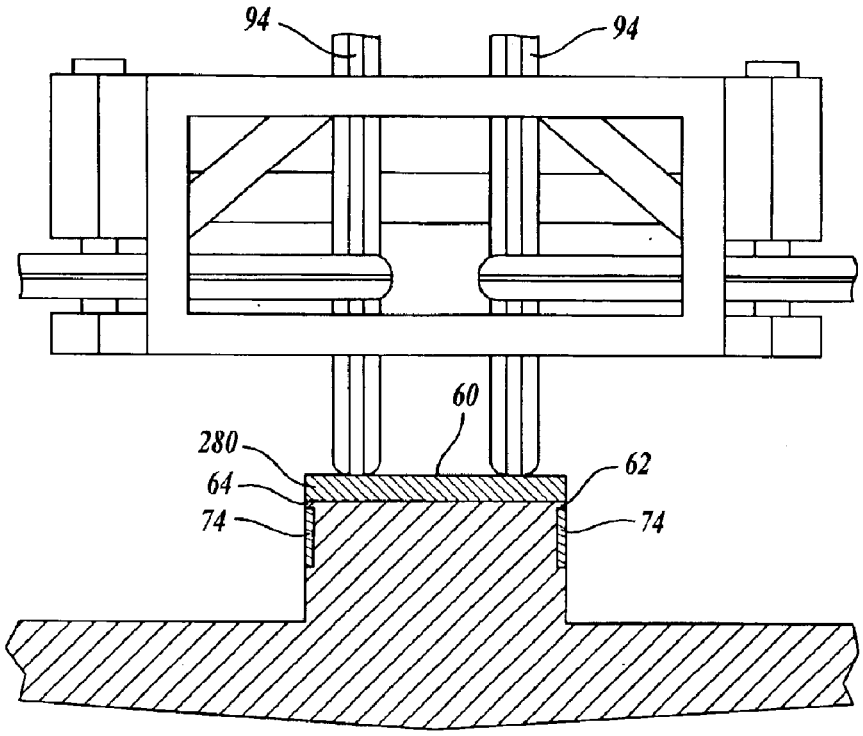
FIG. 10A is a cross-section of the central raised platform of the guideway showing a reaction plate configuration for a linear induction motor.

The outside shape of the guideway 22 may assume any form consistent with the ability of the overall structure to be able to carry the static and dynamic loads generated by the vehicles, and may include any aesthetically pleasing design. These loads, which are usually governed by local laws, and the corresponding structural sections required to carry such loads may be determined by structural engineers skilled in the art of designing bridges or similar structures. It will be appreciated to those skilled in the art that the surfaces 60, 62, 64, 70, and 72 may be configured so as to reduce wear between the guideway and the vehicle, and by way of example, may either be constructed of a wear resistant material, or may include embedded wear resistance plates 74, as shown in FIG. 10A with regard to side switching surfaces 62 and 64.

The particular geometry of the guideway 22 permits the use of relatively large diameter support wheels and lateral guide wheels that act as the primary horizontal and vertical load bearing wheels, as will be described in more detail below. In that capacity, such wheels determine the overall operational characteristics of the vehicles, and consequently, the ride comfort for passengers and/or freight. The configuration of the guideway 22 also permits the use of an in-vehicle switching wheel assembly, in conjunction with a continuous or contiguous vertical-load-bearing top surface 60 without gaps at the branch points. Smooth vehicle operation at normal operating speeds is also aided by the configuration of the in-vehicle switching wheel assembly. The configuration of the in-vehicle switching wheel assembly obviates the need for the guideway cross section to change at branch points, thus eliminating a source of undesirable side-to-side motion of the vehicles while nearing the branch points in the guideway 22, as will be described in more detail below.

Figure 3A:
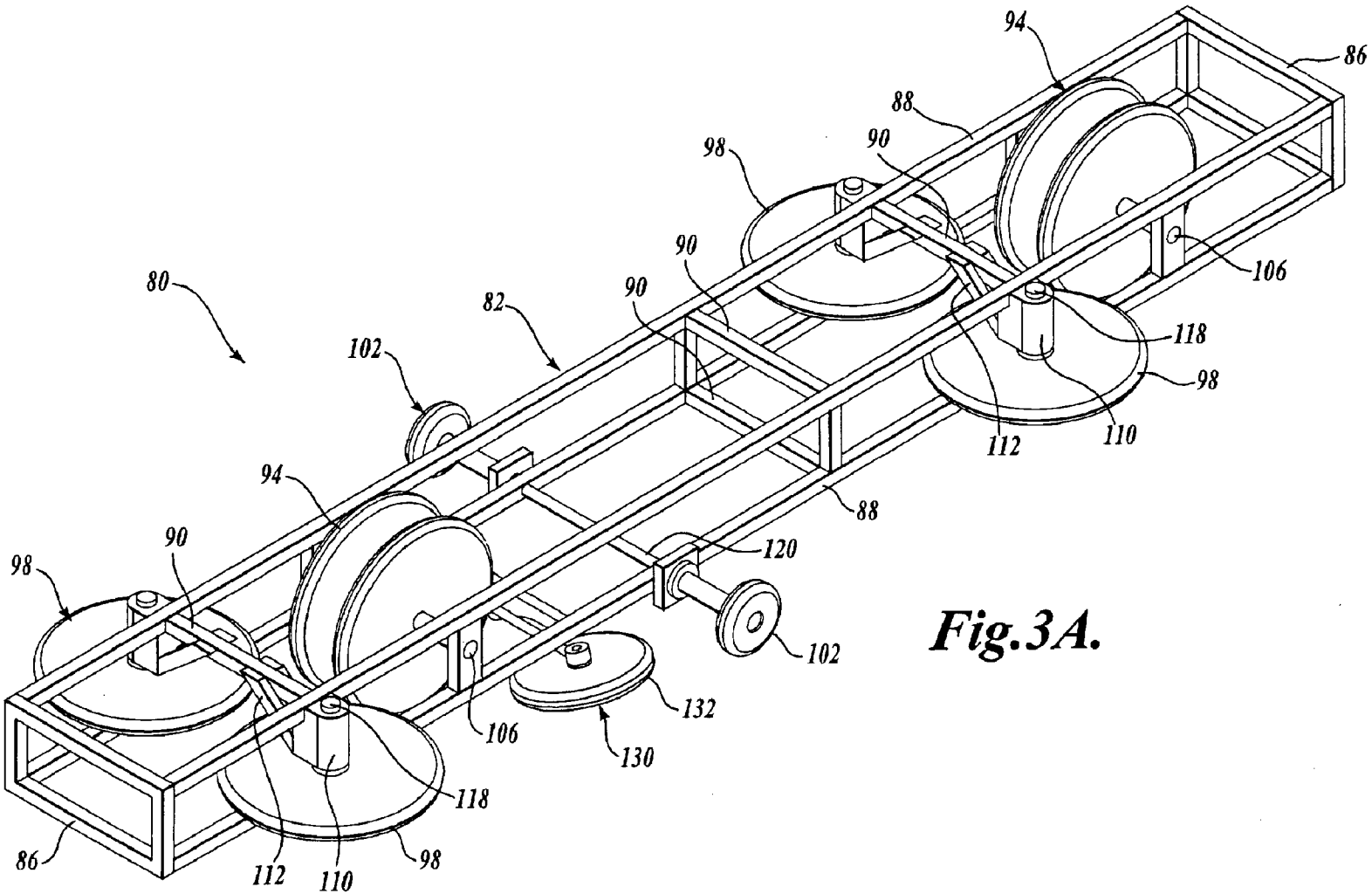
FIG. 3A is a perspective view of an exemplary embodiment of the vehicle bogie of a vehicle utilized by the transportation system of FIG. 1.
Figure 3B:
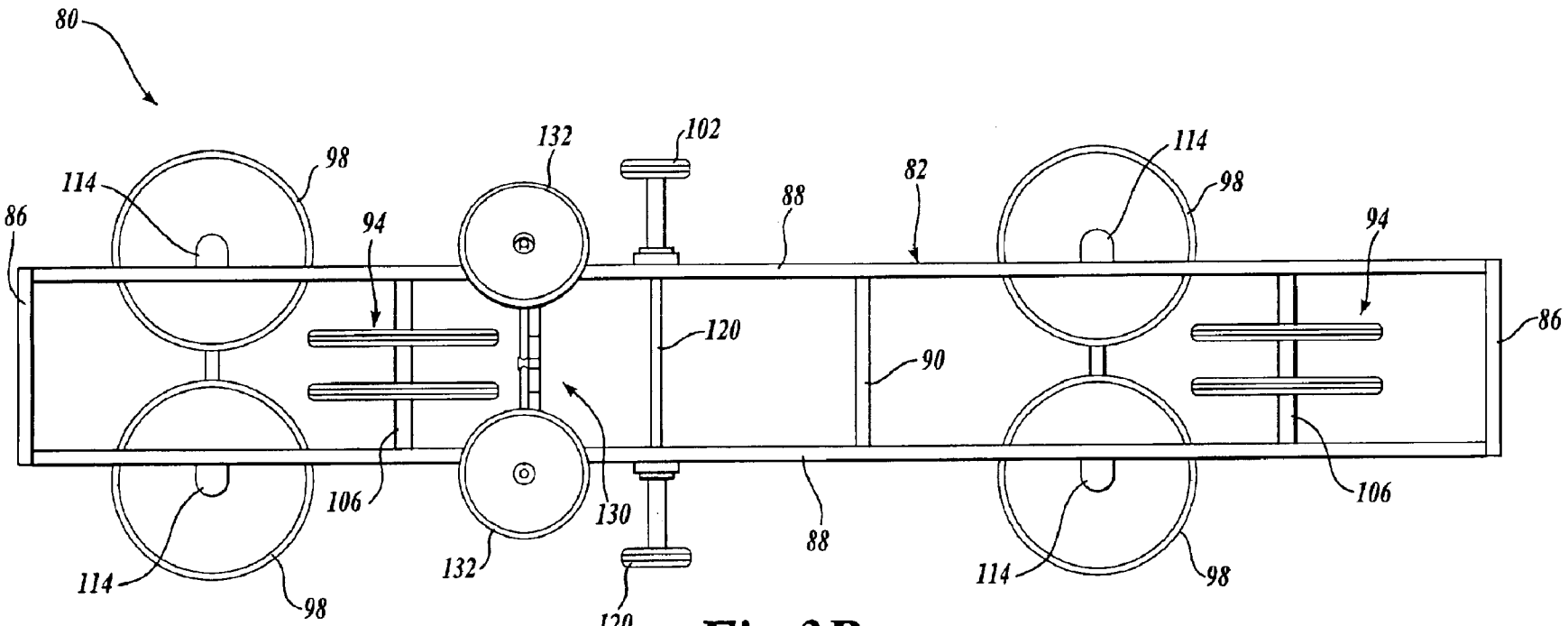
FIG. 3B is a bottom view of the vehicle bogie of FIG. 3A.

The vehicle of the transportation system will now be described in more detail. The vehicle includes a passenger or freight holding structure mounted on top of a vehicle bogie for mating the vehicle to the guideway. One non-limiting example of the bogie, generally designated 80, is best shown in FIGS. 3A and 3B. The bogie 80 comprises a support frame 82 that rotatably supports a plurality of wheels. The bogie 80 may include other components well known in the transportation art but not shown for ease of illustration such as linear induction or electric motors that provide a drive source to the vehicle, as will be described in more detail below. In the embodiment shown, the support frame 82 is formed by spaced-apart rectangular end brackets 86 interconnected by longitudinal beams 88 at the corners of the end brackets 86. The support frame 82 includes other structure components, such as lateral cross braces 90, to provide rigidity to the bogie 80. The plurality of wheels may, for example, include two spaced-apart pairs of support wheels 94, two spaced-apart pairs of lateral guide wheels 98 and two torsional support wheels 102, all rotatably connected to the support frame 82. It will be apparent that a greater or lesser number of wheels may be used as needed by the requirements of the vehicle or guideway, and thus, is contemplated to be within the scope of the present invention.

The support wheels 94 primarily carry the load of the vehicle. The support wheels 94 are carried about axles 106 that are coupled to the support frame 82. The axles 106 may either be "live" axles, wherein the axles 106 are journaled on the beams 88 through conventional bearings with the wheels 94 being fixed to the axles 106 for rotation therewith, or "dead" axles, wherein the wheels 94 are rotatably connected to axles 106 fixedly secured to the support frame 82. In either case, the axles 106 define the rotational axes of the support wheels 94, which are substantially parallel to the top surface of the guideway, as well as to the passenger floor of the vehicle. In the embodiment shown, the support wheels 94 are arranged as two spaced-apart pairs of wheels, preferably having one wheel of each pair of wheels on each side of the longitudinal center line of the vehicle. The size and design of the support wheels 94 will be generally dictated by the weight of the vehicle and the speed at which the vehicle will travel. The support wheels 94 may be of a conventional construction known in the art, and thus will not be described in any more detail. In one embodiment, the diameter of the support wheels 94 may be in the range of 17 to 25 inches; however, smaller and larger diameters are completed to be within the scope of the present invention.

The support frame 82 further includes upper hub members 110 secured to the upper longitudinal beams 88 of the support frames 82 and supported by diagonal struts 112, and lower hub members 114 (see FIG. 3B) secured to the lower longitudinal beams 88 directly below the upper hub members 110. The hub members 110 and 114 are positioned outward of the support wheels 94 and define aligned bores into which axles 118 are journaled for rotation. Connected for rotation with the axles 118 in-between the upper and lower hub members 110 and 144 are lateral guide wheels 98. As such, the axles 118 define the rotational axes of the guide wheels 98, which in the embodiment shown, are substantially orthogonal to the rotational axes of the support wheels 94. The lateral guide wheels 98 run along the lateral guide surfaces of the guideway and provide side-to-side and torsional support for the vehicle as it guides the vehicle along the guideway. In one embodiment, the diameter of the lateral guide wheels 98 may be in the range of approximately 17 to 25 inches; however, smaller and larger diameters are completed to be within the scope of the present invention.

The bogie 80 may optionally include torsional support wheels 102. The torsional support wheels 102 are rotatably connected to the support frame 82 through an axle 120. Similar to the axles 106, the axle 120 may either be "live", as shown in FIGS. 3A and 3B, or "dead". In either case, the axle 120 defines an axis of rotation, which in the embodiment shown, is substantially parallel to the axes of rotation of the support wheels 94. Alternately, the rotational axis of the torsional support wheels 102 may form an acute angle with the rotational axes of the support wheels 94. The torsional support wheels 102 are shown disposed in-between the pairs of support wheels 94; however, they may be disposed in other suitable locations along the support frame 82. The torsional support wheels 102 run along the torsional stabilizing surfaces of the guideway and allow the vehicle to compensate for further torsional forces that are created at times of low friction or if the vehicle is unevenly loaded, rounding curves, experiencing weather loading, etc.

For travel along most sections of the guideway 22, no steering is necessary since the lateral guide wheels 98 accomplish any required steering function by guiding the vehicle 26 along the guideway 22. However, in applications where the vehicle 26 is to be used with a guideway that includes branch sections, such as the guideway 22 shown in FIG. 1, the vehicle 26 may be equipped with methods for switching the vehicle between the main section 30 and either branch section 34 and 36. To this end, the bogie 80 may optionally include an in-vehicle switching wheel assembly 130 (hereinafter "switching wheel assembly 130"), as best shown in FIGS. 3A, 3B, and 4, having switching wheels 132 that run along the side switching surfaces 62 and 64 of the guideway 22 and permit the vehicle to switch branch sections of the guideway 22 as the vehicle 26 moves along the guideway.

Figure 5:
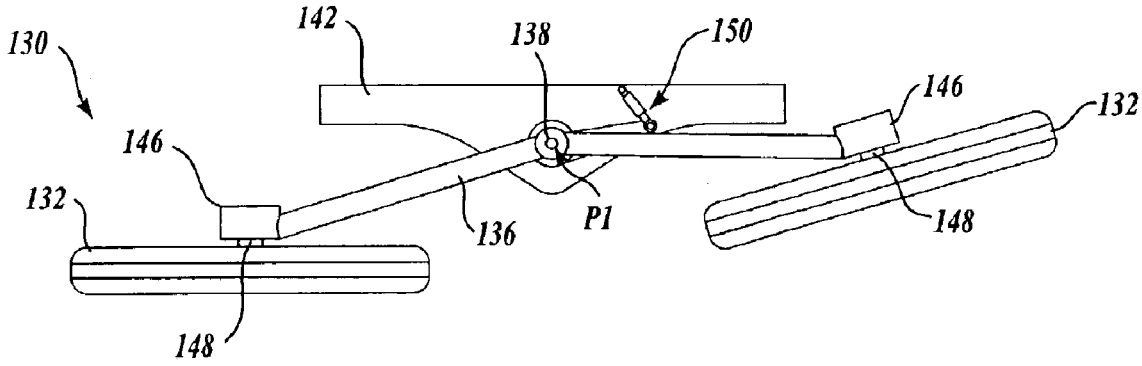
FIG. 5 is a front view of an exemplary embodiment of the switching wheel assembly of a vehicle utilized by the transportation system of FIG. 1.

FIG. 5 illustrates one non-limiting example of the switching wheel assembly 130 formed in accordance with one embodiment of the present invention. The switching wheel assembly 130 includes switching wheels 132 attached at the ends of a main pivoting arm 136. The main pivoting arm 136 is pivotally attached to the vehicle at a central pivot 138 formed by a mounting plate 142 of the support frame, and may be attached to the vehicle at any point which allows the described operation to occur. Thus, the central pivot 138 defines the pivot axis PI of the main pivoting arm 136. In the embodiment shown in FIGS. 3A and 3B, the pivot 137 is located in-between one pair of support wheels 94 and the optional torsional support wheels 102. The main pivoting arm 136 is generally rigid, and shaped such that it pivots up on one side and simultaneously down on the other. In the embodiment shown, the pivot arm is V-shape, angled at approximately between 120–170 degrees. Although such a main pivoting arm is preferred, other configurations that permit the equivalent operation are also permitted and are within the scope of the present invention.

The switching wheels 132 are attached to both ends of the main pivoting arm 136. The attachment of the switching wheels 132 to the main pivoting arm 136 may be in any manner that allows each wheel to rotate about its own generally vertical axis when contacting its respective side switching surface. In this particular embodiment shown best in FIG. 5, the attachment of each switching wheel 132 is preferably non-pivoting. To this end, a mounting hub 146 is fixedly secured at the outermost ends of the main pivoting arm 136. The switching wheels 132 are rotatably coupled to the mounting hubs 146 though axles 148. It will be appreciated that a dampened pivoting connection could also be used to dampen side-to-side motion of the vehicle arising from possible irregularities of the guideway, if desired.

Figure 4:
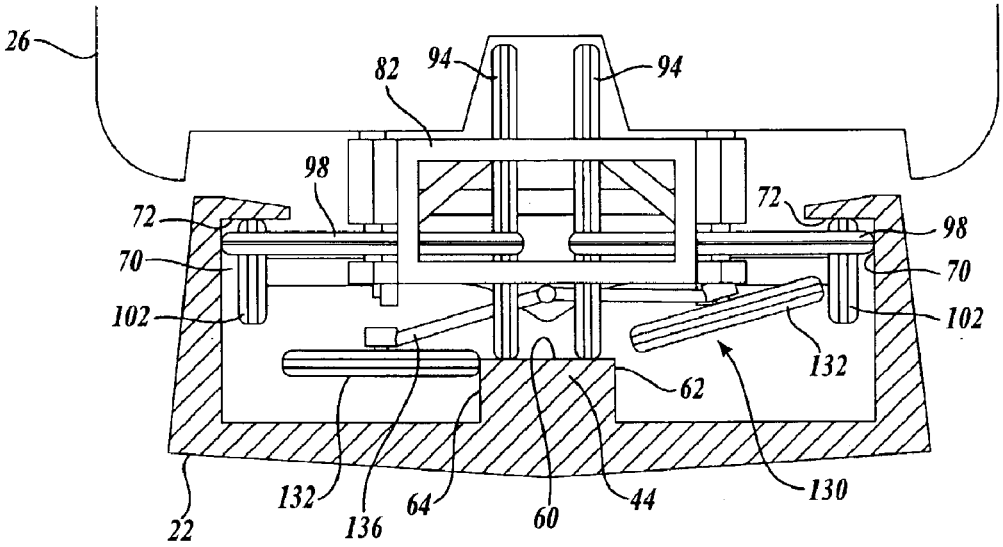
FIG. 4 is a cross-section view of the transportation system of FIG. 1 illustrating a vehicle mating with the cooperating guideway of FIG. 2.

The main pivot arm 136 pivots by actuation of an actuator 150 between a right switching position, wherein one switching wheel 132 is in contact with the side switching surface 62 (FIG. 2), and a left switching position, wherein the other switching wheel 132 is in contact with the side switching surface 64, as best shown in FIG. 4. When pivoted by the actuator 150, the switching wheel 132 which is not in contact with either switch surface 62 or 64 is permitted to extend high enough so as to clear the top surface 60 of the raised central platform 44, as the switching wheels 132 will need to pass over the raised central platform 44 when the vehicle passes the guideway branch point. In operation, if the switching wheel 132 on the right side of the vehicle is in contact with the switch surface 62 (i.e., the left switching position), then the vehicle will be forced to take the right branch section 34 of the guideway 22. If the switching wheel 132 on the left side of the vehicle is in contact with the switch surface 64 (i.e., the left switching position), then the vehicle will be forced to take the left branch section 36 of the guideway 22.

The switching wheel assembly 130 may be biased utilizing any means known to those skilled in the construction of mechanical devices such that it will not remain in an intermediate position with no support wheels 94 in contact, but instead will switch to either right or left switching position so that one wheel is in contact with the appropriate side switching surface 62 or 64 while the other switching wheel 132 on the other side is clear of the central raised platform 44. A locking mechanism (not shown) or a sufficiently fail-safe control mechanism known in the art may be included such that if one switching position is selected, the switching wheel assembly 130 will not switch to the other switching position undesirably without positive action from a control module.

Figure 6:
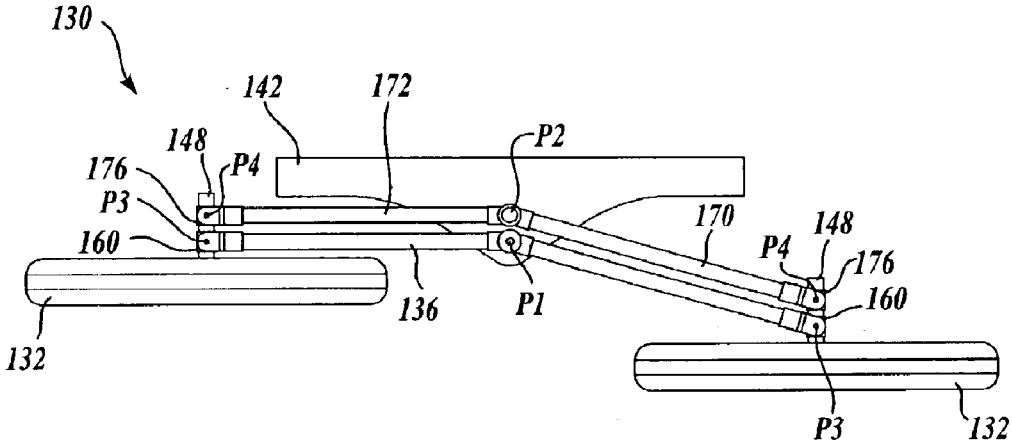
FIG. 6 is a front view of an alternative embodiment of the switching wheel assembly.

In accordance with another embodiment, the switch assembly 130 may be configured to keep each switching wheel 132 horizontal during the full range of its up/down motion, thereby reducing the amount of travel of the wheels to clear the top surface 60. One non-limiting example of such a configuration is shown in FIG. 6. In FIG. 6, the switching wheel assembly 130 includes a main pivot arm 136, the ends of which are pivotally connected to the axles 148 of the switching wheels 132 through pivot collars 160. Pivot collars 160 are pivotally connected to the ends of the main pivot arms such that they pivot about pivot P3, the pivot axis of P3 being substantially orthogonal to the rotational axes of the switching wheels 132.

The switching wheel assembly 130 further includes leveling arms 170 and 172, the inward ends of which are pivotally connected to the mounting plate 142 about pivot P2. Thus, each leveling arm 170 and 172 is suitably independent of the other. At the outward ends of each leveling arm 170 and 172, pivot collars 176 are pivotally coupled thereto about pivots P4, the pivot axis of P4 being substantially orthogonal to the rotational axes of the switching wheels 132. The pivot collars 176 are sized and configured to rotatably receive the axles 148 of switching wheels 132. The leveling arms 170 and 172 may be either above or below the main pivoting arm 136. In either case, on each side, the distance between the pivots P1 and P2 may, and in some embodiments must be the same as the distance between pivots P3 and P4. Also, on each side the distance between P1 and P3 may, and in some embodiments must be the same as the corresponding distance between P2 and P4 (it is not strictly required for the distances P1 to P3 and P3 to P4 on one side of the vehicle to be the same as those distances on the other side of the vehicle).

As was described above, the leveling arms retain the switching wheels substantially horizontal or parallel with the floor of the vehicle, thereby reducing the amount of travel of the wheels to clear the top surface 60. The leveling arms 170 and 172 may also help to absorb some of the torsional force exerted on the main pivoting arm 136 by the switching wheels 132 by acting to redirect a component of this torsional force to the vehicle and through the vehicle ultimately to the lateral guide wheels 98 and optional torsional stabilizing wheels 102. This action of redirecting a component of the torsional force helps to decrease the force on any locking mechanism included to keep the switching mechanism stable in each of its two extreme switching states, thereby allowing a decrease in the size and weight of such a locking mechanism.

Figure 7:
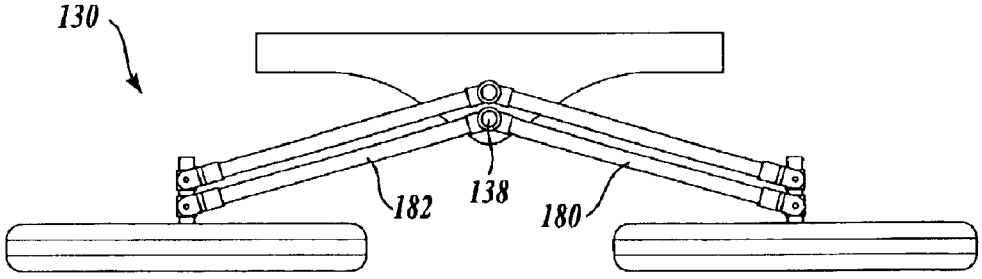
FIG. 7 is a front view of another alternative embodiment of the switching wheel assembly.

As was described above, steering for selecting one of the two branch sections may be accomplished by the switching wheel assembly 130 such that either one or the other switching wheels 132 is in contact with the corresponding switch surfaces 62 or 64, but generally not both at the same time. However, an embodiment where both branch switching wheels 132 may contact the switch surfaces 62 or 64 is also within the scope of the present invention. One non-limiting example of such a configuration is shown in FIG. 7. In FIG. 7, the main pivoting arm is composed of right and left pivot arms 180 and 182 that pivot about central pivot 138 independently of one other. In this embodiment, it will be appreciated that two actuators 150 (FIG. 5) are needed to raise and lower the right and left switching wheels 132.

For smoother operation at moderate to high speeds, it may be desirable to keep both switching wheels 132 on either side of the vehicle spinning at about the same rate while the vehicle is in motion, rather than allowing that switching wheel 132 which is not in contact with the guideway at a given time to come to a standstill. Failing to keep the non-contacting switching wheel in motion necessitates bringing the switching wheel up to a high rate of rotation quickly when the switching wheel does come into contact with the corresponding side switching surface 62 or 64 as soon as a switch from one switching position to the other is initiated. This action of quickly bringing the switching wheel up to a high rate of rotation may be difficult to accomplish smoothly simply by relying on the friction of the switching wheel against the guide surface. One possible method to keep both switching wheels spinning at about the same rate is to include a mechanical linkage such as a chain, belt, rod or other device, along with the appropriate gearing and transfer mechanisms, for example, universal joints or constant velocity joints, as required, that pivot with and may be attached to the switching wheel assembly 130, and transfers the rotation from one switching wheels 132 to the other, in this manner keeping the two wheels synchronized. Other methods of linking the switching wheels 132 are also possible, for example, by utilizing a hydraulic linkage. It is also possible to have each switching wheel 132 driven by an electric motor, and either run the non-contacting wheel continuously, or only spin it up to the speed of the vehicle just prior to a side-selection switch taking place, otherwise allowing it to come to rest if no side-selection switch takes place for some time, i.e., the vehicle is traveling along the same guideway for an extended period of time.

As was described above, the raised central platform 44 allows for the top surface 60 to be continuous without gaps, notably throughout the branch sections of the track where switching occurs, and having side switching surfaces 62 and 64 that are situated below the primary top, load-carrying surface 60. This is accomplished by configuring the switching wheels 132 on the outside of the support wheels 60 such that at a guideway branch point, the load support wheels 60 do not need to cross either of the side switching surfaces 62 or 64. A continuous top surface 60 without gaps permits higher speed operation of the vehicle and more comfortable operation for passengers or freight because of the creation of a smooth surface. A further consideration when attempting to provide a smooth operation is to avoid the necessity for the primary load bearing wheels 60 to cross any side-guiding and stabilizing surfaces, which is accomplished by configuring the lateral guide and torsional stabilizing surfaces 70 and 72 to be on the inside of the outer stabilizing walls 46 of the guideway 22, and the bottom of the top flange 56, respectively.

The operation of the vehicle traveling along the guideway 22 will now be described with references to FIGS. 1 and 4. Referring now to FIG. 4, there is shown a cross-section view of the vehicle 26 mating to its cooperating guideway 22 at the main guideway section. In FIG. 4, the vehicle 26 is supported by the support wheels 94 contacting the top surface 60 of the central raised platform 44, the lateral guide wheels 98 are contacting the lateral guide surfaces 70 of the guideway 22, the optional torsional support wheels 102 are contacting the torsional stabilizing surfaces 72 of the guideway 22, and the switching wheel assembly 130 is in the left switching position with the switching wheel 132 engaged against the side switching surface 64.

Under normal operating conditions, as the vehicle 26 moves along the guideway section 30 toward the branch point 32 of FIG. 1, the lateral guide wheels 98 provide side-to-side and torsional support for the vehicle 26 as it guides the vehicle 26 along the guideway section 30. Simultaneously, the optional torsional support wheels 102 run along the torsional stabilizing surfaces 72 of the guideway section 30 and allow the vehicle 26 to compensate for further torsional forces that are created at times of low friction or if the vehicle is unevenly loaded, experiencing weather loading, etc. Additionally, the lateral guide wheels 98 also act together with the frictional forces exerted by support wheels 94 acting against side slippage on top surface 60 and to counteract torsional forces on the vehicle 26, such as arising from uneven loading, weather loading, centrifugal forces while rounding turns, etc. As the vehicle continues to move along the guideway section 30, the optional torsional stabilizing wheels 102 work as a secondary constraint to counteract any torsional forces applied thereto. In case of loss of friction between support wheels 94 and top surface 60, such as when operating under inclement weather conditions, torsional wheels 102 may then provide the primary constraint against any torsional forces.

As the vehicle 26 approaches the branch point 32 shown in FIG. 1, the vehicle 26 may switch between either the right branch section 34 and the left branch section 36, based on the predetermined destination of the vehicle 26. If the destination of the vehicle 26 requires the vehicle to use the left branch section 34, the vehicle control system then determines if the correct switching wheel 132 is lowered into contact with its corresponding side switching surface 62 or 64. Since the left branch section is to be selected, and the main pivot arm 136 is in the left switching position as best shown in FIG. 4, the main pivot arm 136 remains in such a position as the vehicle 26 enters the branch point 32. If, however, the main pivot arm 136 is in the right switching position, the actuator 150 (FIG. 5) is actuated to pivot the main pivot arm 136 into the left switching position shown in FIG. 4.

As the vehicle 26 enters the branch point 32 to switch to the left branch section 34, the lateral support wheel 98 on the right side of the vehicle 26 is not in contact with surface 70. At this time, the torsional forces in the direction that would otherwise be counteracted by the now non-contacting right lateral guide wheel 98, are briefly counteracted by the optional torsional wheel 102 on the opposite side (i.e. left side) of the vehicle 26. Any such torsional forces in the other direction (i.e. right side), normally counteracted by the now non-contacting right torsional wheel 102 while the vehicle 26 passes the branch point 32 of the guideway section 30, are counteracted during this time by the left guide wheel 98, which is on the left side of the vehicle maintaining contact with its corresponding surface 70, working in conjunction with frictional action of support wheels 94 against the top surface 60. In the case of loss of friction between support wheels 94 and the top surface 60, these torsional forces are compensated by the left switching wheel 132 that is in contact with its corresponding side switching surface 64. The switching wheels 132 are able to assume this additional stabilizing function because they are separated into a different plane than the lateral guide wheels 98 (see FIG. 4), i.e. the switching wheels 132 run along or react against opposite surfaces, and the plane of the switching wheels 132 is below the plane of lateral guide wheels 98.

After the vehicle exits the branch point 32 and enters into the left branch section 36, the wheels of the vehicle 26 contact their corresponding surfaces in a manner similar to FIG. 4.

Figure 8:
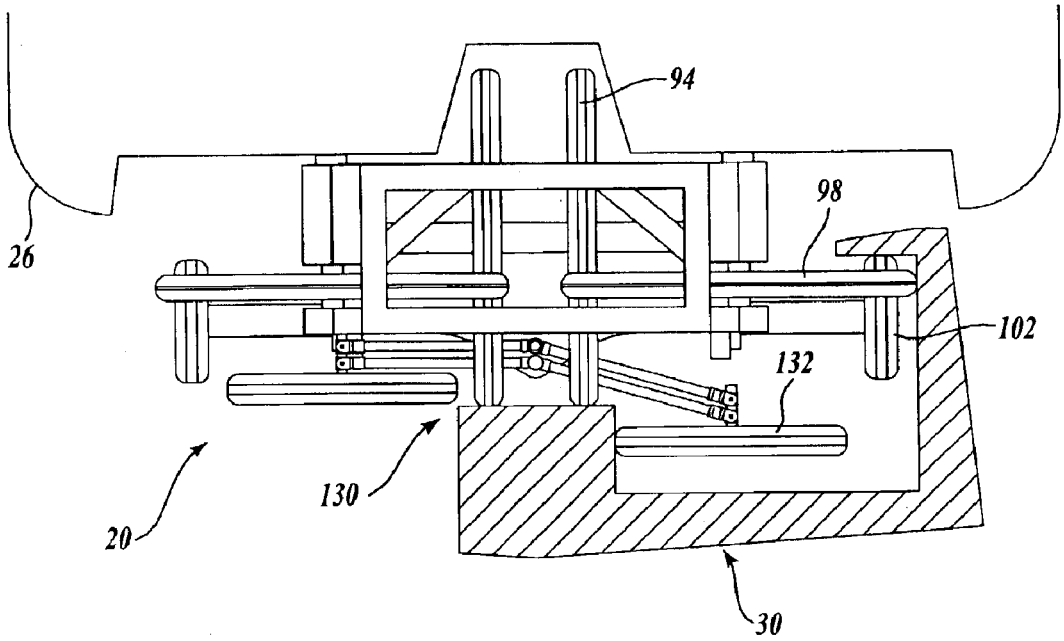
FIG. 8 is a cross-section of an alternative guideway configuration showing only one side of the guideway with an internal guideway surface.

In another embodiment of the transportation system 20, on sections of the guideway without branch sections, such as the main guideway sections 30, it is possible to omit one side of the guideway, as shown in FIG. 8. In this application, appropriate safeguards (not shown) are preferably included to ensure that the switching wheel 132 on the side of the guideway opposite the omitted section remains positively locked in the down position. In this mode of operation, the torsional wheel 102 acting in conjunction with support wheels 94 provide the constraint against torsional forces in one direction, while the switching wheel 132 acting in conjunction with the lateral guide wheel 98 provides the constraint against any torsional forces in the other direction. The corresponding opposite side wheels are not in contact with any surface while the vehicle is traveling along main guideway section 30 of the guideway 22 where one side is omitted.

Figure 11:
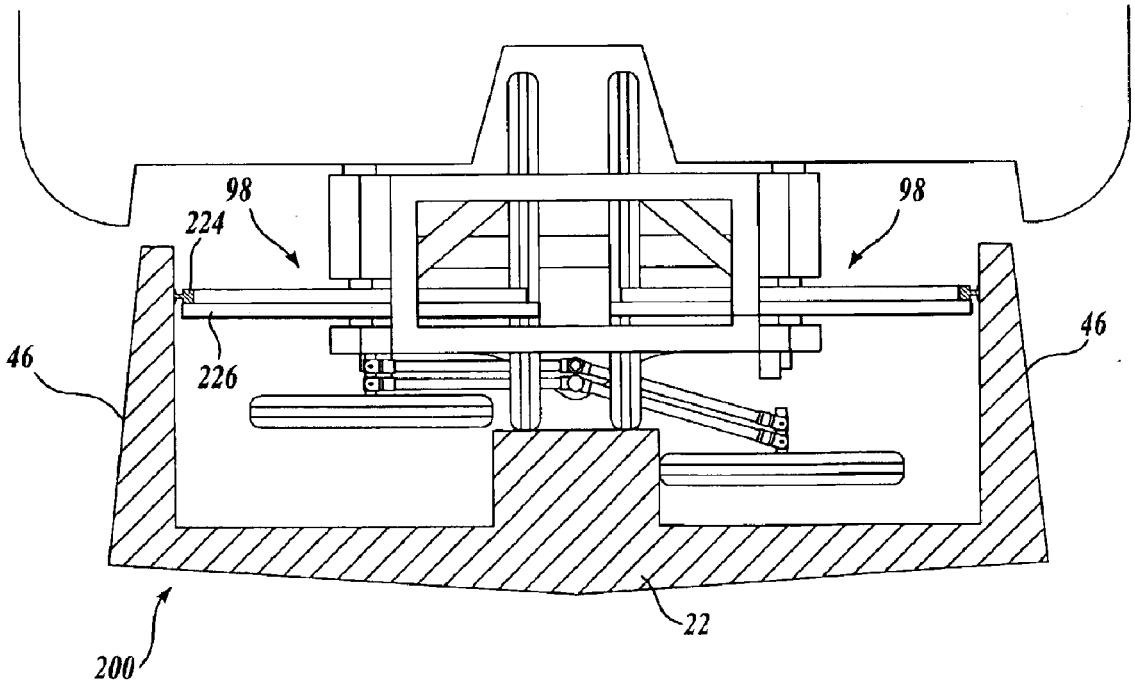
FIG. 11 is a cross-section of the guideway showing an alternative embodiment of a transportation system.

FIG. 11 illustrates in cross section an alternate embodiment of a transportation system 200. The system 200 is substantially identical in construction and operation as the system 20 described above, except for the difference that will now be described. For clarity in the ensuing description, similar elements to system 20 have the same reference numerals. The guideway 22 in this embodiment includes rails 224 attached to the inside surfaces of the side stabilizing walls 46. The lateral guide wheels 98 include an annular bottom flange 226 that mates with the bottom planar surface of rails 224, while the outer side surfaces of the upper guide wheels 98 contact the inward facing surfaces of the rails 224. The rails 224 may take the form of any rail sufficient to support the wheel flange 226. The flanges 226 of the wheels 98 assume the function of counteracting any torsional forces that are created at times of low friction or if the vehicles are unevenly loaded, rounding curves, experiencing weather loading, etc. In this capacity, the flanges 226 of the wheels 98 assume the function of the torsional support wheels 102 (FIG. 4), which may then be omitted in this embodiment. In certain circumstances, both the flanges 226 and the torsional support wheels 102 may be employed, if desired.

Stability against torsional forces about the longitudinal axis of the vehicle may be aided by the relative width of the guideway 22 to the width of the vehicle. An additional aid to stability is the open top of the guideway 22, allowing attachment of the vehicle to the wheels at points that are relatively wide apart compared to the width of the vehicle. Also, the guideway 22 formed in accordance with embodiments of the present invention assure vehicle stability even in the event of loss of friction between the wheels and the guideway surfaces, facilitating open-air outdoor operation in all weather conditions including rain, snow, etc., particularly if vehicle propulsion and breaking are provided by a friction-independent means such as a linear induction motor. In addition, the guideway 22 is also suitable for elevated applications, as well as indoor, at-grade, and tunnel applications.

In all of the embodiments of the present invention, propulsion of the vehicle may be provided by any suitable means known in the art. One example of a suitable propulsion system is a linear induction motor (not shown). Other means of providing propulsion is to drive either or both the front or rear support wheels 94 by any suitable power source, such as (but not limited to) an electric motor, connected either directly to the wheels 94 or through a suitable gearing linkage. Other examples of means of propulsion of the vehicle, which may be suitable for some applications, include, but are not limited to, air-propeller propulsion or jet engine propulsion.

Figure 9:
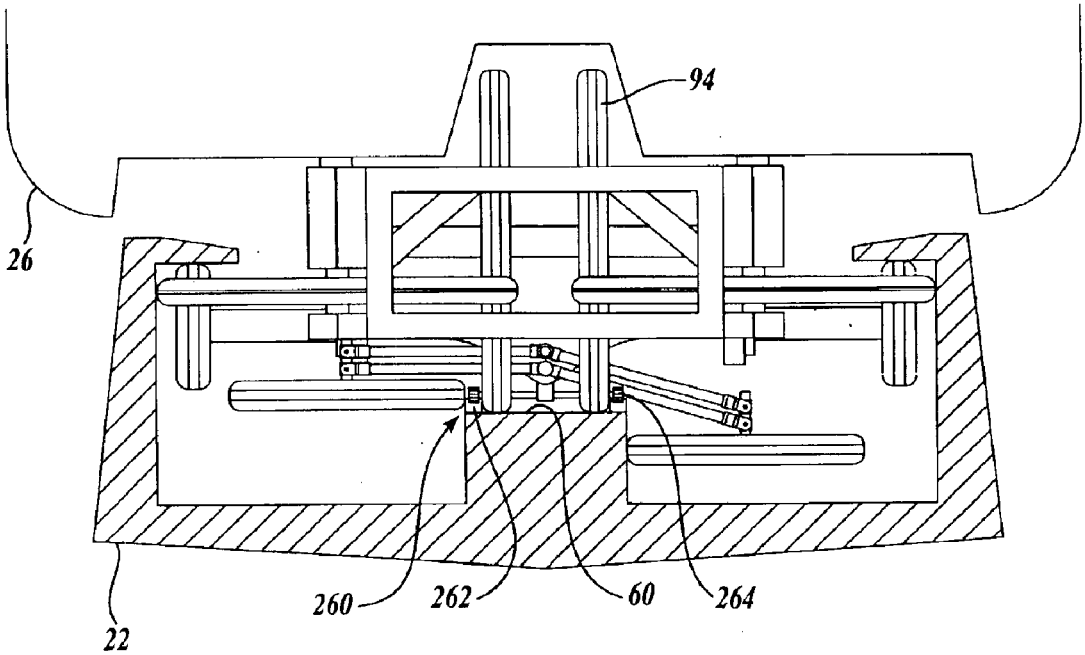
FIG. 9 is a cross-section of the guideway showing a rack and pinion traction enhancement in accordance with one embodiment of the present invention.

For applications where propulsion is provided by means that rely on traction between the wheels 94 and the top surface 60 and where insufficient traction may occur, for example on steep inclines, it is possible to provide additional traction by adding a rack-and-pinion arrangement 260 to the guideway alongside the support wheels 60, as shown in FIG. 9. In FIG. 9, the rack 262 is attached to the guideway 22, and the pinion 264 is attached to the vehicle 26 and is provided with power to drive the vehicle 26. The vehicle 26 preferably has a pinion 264 on both sides of wheels 94 in order to be able to engage with the rack 262 on either side of surface 60 on portions of the guideway where a branch section occurs. On portions of the guideway without a branch section, the rack 262 may be provided on one or both sides of the surface 60.

Figure 10B:
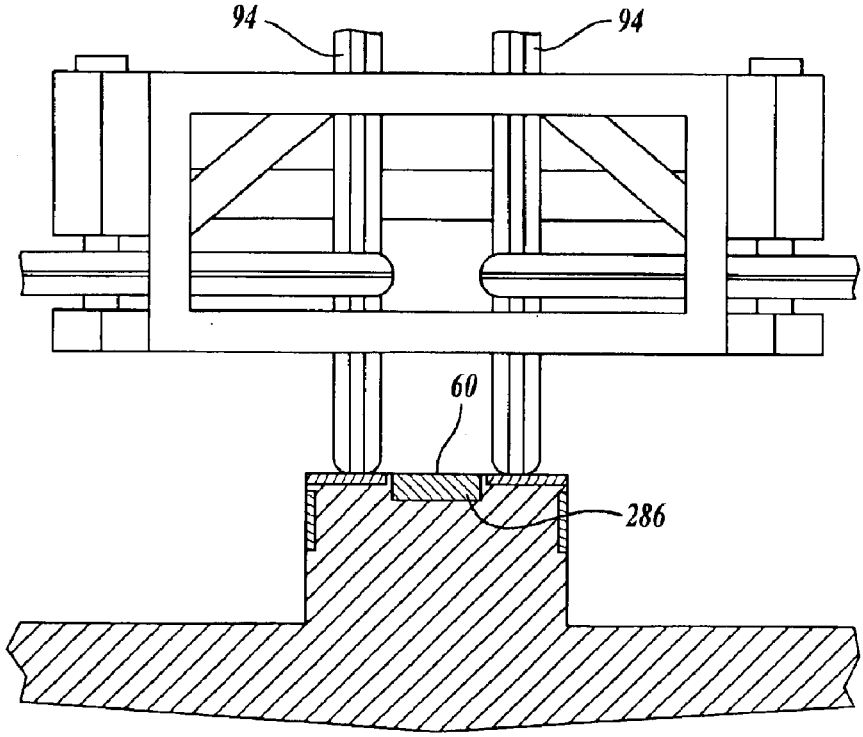
FIG. 10B is a cross-section of the central raised platform of the guideway showing an alternative reaction plate configuration for a linear induction motor.
Figure 10C:
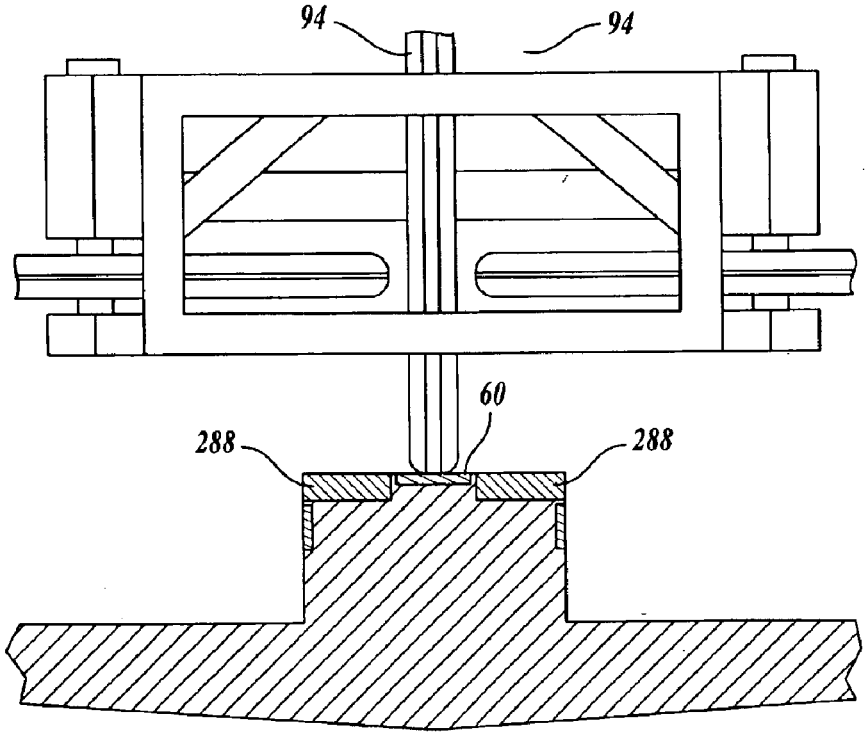
FIG. 10C is a cross-section of the central raised platform of the guideway showing another alternative reaction plate configuration for a linear induction motor.

In embodiments were the propulsion of the vehicle is provided by a linear induction motor, a reaction plate 280 of the linear induction motor may optionally form the top surface 60, and the support wheels 94 may be configured to run directly on the reaction plate 280, as best shown in FIG. 10A. Another possible configuration of the top surface 60 in applications where propulsion is provided by a linear induction motor, includes locating a reaction plate 286 of the linear induction motor in the center of the top surface 60, and positioning the running surfaces for the wheels 94 on either side, as best shown in FIG. 10B. Another possible configuration, shown in FIG. 10C, is to include two linear induction motors, and locate the respective reaction plates 288 on each side of the top surface 60, while the top surface 60 for wheels 94 is approximately in the center. In this embodiment, only one wheel may be used, as shown. Linear induction motors selectively acting against reaction plates embedded in the side stabilizing walls 70 or flanges 72 are also possible, and thus, within the scope of the present invention.

The guideway-based transportation system described above and illustrated herein is used to transport people and goods. Vehicle operation is usually automatic, with the vehicles traverse along a dedicated guideway. The overall operation of the system is controlled by either a centralized or distributed control system, which may be developed by a team of practitioners of the discipline of control system design or related fields by applying principles known in the art. This control system continuously collect data describing the location of individual vehicles, which may be accomplished by any number of means readily designed and assembled from commonly available components by those skilled in the art of industrial control systems design or in similar disciplines. Individual vehicle capacities may be under 12 persons, with 1 to 6 being the most common range. Passenger embarkation is usually accomplished at siding guideways, so that only vehicles that take on or discharge passengers at a particular stop along a line need to stop at that point, and other vehicles may pass along unimpeded. Such an arrangement allows a particular trip for one passenger (or one group of passengers) to proceed from an originating stop to a destination stop without stopping along the way, leading to a decrease in trip time compared to traditional mass transit systems which typically need to stop at a number of stops along a route.

While illustrative embodiments of the invention have been illustrated and described, it will be appreciated that various changes can be made therein without departing from the spirit and scope of the invention.

The embodiments of the invention in which an exclusive property or privilege is claimed are defined as follows:

1. A vehicle bogie to which a passenger or freight holding structure is mounted, the vehicle bogie matable with a transportation system guideway having a central raised platform defining a running surface and at least one lateral side wall defining first and second lateral running surfaces, the vehicle bogie comprising:

a support frame;

at least one support wheel rotatably connected to the support frame about a first rotational axis, the support wheel adapted to contact the running surface of the central raised platform of the guideway for supporting the vehicle bogie on the guideway;

at least one guide wheel rotatably connected to the support frame about a second rotational axis, the guide wheel spaced outward from the support wheel and disposed above the central raised platform so as to allow the guide wheel to pass thereover during use, the guide wheel being adapted to contact the first lateral running surface of the lateral sidewall; and at least one torsional support wheel rotatably connected to the support frame about a third rotational axis substantially parallel to the first rotational axis, the torsional support wheel adapted to contact the second lateral running surface of the lateral side wall.

2. The vehicle bogie of claim 1, wherein the first rotational axis is substantially parallel to a floor of the holding structure.

3. The vehicle bogie of claim 1, wherein the second rotational axis is substantially orthogonal to the first rotational axis.

4. A vehicle bogie to which a passenger or freight holding structure is mounted, the vehicle bogie matable with a transportation system guideway having a central raised platform and lateral side walls, the vehicle bogie comprising:

a support frame;

at least one support wheel rotatably connected to the support frame about a first rotational axis, the support wheel adapted to contact a running surface of the central raised platform of the guideway for supporting the vehicle bogie on the guideway:

at least one guide wheel rotatably connected to the support frame about a second rotational axis, the guide wheel spaced outward from the support wheel and adapted to contact a first lateral running surface of the lateral sidewall; and a switching wheel assembly operably coupled to the support frame, the switching wheel assembly including a main pivot arm pivotally connected to the support frame at approximately the center point of the main pivot arm, and first and second switch wheels rotatably connected to the ends of the main pivot arm about fourth and fifth rotational axes, wherein the switch wheels are disposed outward of the support wheels and are adapted to contact switch wheel running surfaces defined by the central raised platform.

5. The vehicle bogie of claim 4, wherein the main pivot arm is pivotable between a first position and a second position, the first position placing the first switch wheel in contact with a first switch wheel running surface of the central raised platform and the second position placing the second switch wheel in contact with a second switch wheel running surface of the central raised platform.

6. The vehicle bogie of claim 5, wherein the first or second switch wheel is positioned below the support wheels when either of the first or second switch wheel is on contact with the respective first or second switch wheel running surface.

7. The vehicle bogie of claim 4, wherein the fourth and fifth rotational axes are substantially parallel to the second rotational axis.

8. The vehicle bogie of claim 4, wherein the switching wheel assembly further includes leveling arms pivotally coupled at outer ends to the switch wheels.

9. The vehicle bogie of claim 4, further comprising at least one torsional support wheel rotatably connected to the support frame about a third rotational axis, the torsional support wheel adapted to contact a second lateral running surface of the lateral side wall.

10. A guideway of a transportation system, comprising:

a floor;

a centrally disposed raised platform extending away from the floor, the platform defining a top running surface and two side switching surfaces;

at least one lateral side stabilizing wall spaced-apart from the raised platform and extending away from the floor, the stabilizing wall defining a substantially planar guide running surface;

wherein the side stabilizing wall further includes a flange member inwardly extending from the side stabilizing wall, the flange member defining a generally planar torsional running surface.

11. The guideway of claim 10, wherein the guide running surface is substantially orthogonal to the top running surface.

12. The guideway of claim 10, wherein the top running surface is substantially orthogonal to the side switching surfaces.

13. The guideway of claim 10, wherein the torsional running surface is substantially parallel to the top running surface.

14. The guideway of claim 10, wherein the flange is a rail mounted to the inner surface thereof, the rail defining the torsional running surface.

15. The guideway of claim 14, wherein the rail further defines the guide running surface.

16. A transportation system comprising:

a guideway including a floor, a centrally disposed raised platform extending away from the floor, the platform defining a top running surface and two side switching surfaces disposed below the top running surface, and at least one lateral side stabilizing wall spaced-apart from the raised platform and extending away from the floor, the stabilizing wall defining a substantially planar guide surface; and a vehicle including a bogie having a support frame, at least one support wheel rotatably connected to the support frame that contacts the top running surface, at least one guide wheel rotatably connected to the support frame that contacts the guide surface, and a switching wheel assembly, the switching wheel assembly including a main pivot arm and switch wheels carried at the ends of the main pivot arm, either one of the switch wheels engaging against one of the side switching surfaces.

17. A guideway of a transportation system, comprising:

a first guideway section including a first floor, a first centrally disposed raised platform extending away from the first floor, the first platform defining a first top running surface and two first side switching surfaces, and two first lateral side stabilizing walls extending away from the first floor on both sides of the first raised platform, the first stabilizing wall defining a substantially planar guide surface; and a second guideway section connected adjacent the first guideway section, the second guideway section including a second floor connected to the first floor, a second centrally disposed raised platform contiguously connected with the first centrally disposed raised platform, the second raised platform extending away from the second floor and defining a second top running surface and two second side switching surfaces, and a second side stabilizing wall extending away from the second floor on one side of the second raised platform, the second stabilizing wall defining a substantially planar guide surface, wherein the first and second running surfaces and the first and second side switching surfaces are connected such as to form contiguously planar running surfaces.

18. A vehicle bogie to which a passenger or freight holding structure is mounted, the vehicle bogie matable with a transportation system guideway having a central raised platform defining a running surface and at least one lateral side wall defining a first lateral running surface and including an inwardly projecting flange, the vehicle bogie comprising:

a support frame;

at least one support wheel rotatably connected to the support frame about a first rotational axis, the support wheel adapted to contact the running surface of the central raised platform of the guideway for supporting the vehicle bogie on the guideway;

at least one guide wheel rotatably connected to the support frame about a second rotational axis, the guide wheel spaced outward from the support wheel and disposed above the central raised platform so as to allow the guide wheel to pass thereover during use, the guide wheel being adapted to contact the first lateral running surface of the lateral side wall;

at least one torsional support wheel rotatably connected to the support frame about a third rotational axis substantially parallel to the first rotational axis, the torsional support wheel adapted to contact a second lateral running surface defined by the flange of the lateral side wall; and a switching wheel assembly operably coupled to the support frame, the switching wheel assembly including a main pivot arm pivotally connected to the support frame at approximately the center point of the main pivot arm, and first and second switch wheels rotatably connected to the ends of the main pivot arm about fourth and fifth rotational axes, wherein the switch wheels are disposed outward of the support wheels and are adapted to contact switch wheel running surfaces defined by the central raised platform.

19. A transportation system comprising:

a guideway including a floor, a centrally disposed raised platform extending away from the floor, the platform defining a top running surface and two side switching surfaces disposed below the top running surface, and at least one lateral side stabilizing wall spaced-apart from the raised platform and extending away from the floor, the stabilizing wall defining a substantially planar guide surface and including an inwardly projecting flange defining a substantially planar torsional support surface; and a vehicle including a bogie having a support frame, at least one support wheel rotatably connected to the support frame that contacts the top running surface, at least one guide wheel rotatably connected to the support frame that contacts the guide surface and is disposed above the top running surface, at least one torsional support wheel that contacts the torsional support surface, and a switching wheel assembly including first and second switch wheels each movable for engaging against one of the side switching surfaces.

* * * * *

UNITED STATES PATENT AND TRADEMARK OFFICE

CERTIFICATE OF CORRECTION

PATENT NO. : 6,857,374 B2
DATED : February 22, 2005
INVENTOR(S) : M. Novacek

It is certified that error appears in the above-identified patent and that said Letters Patent is hereby corrected as shown below:

Column 12,
Line 44, "sidewall;" should read -- side wall; --.
Line 67, "guideway:" should read -- guideway; --.

Column 13,
Line 5, "sidewall;" should read -- side wall; --.
Line 24, "is on contact" should read -- is in contact --.
Line 39, "a floor;" should read -- a floor; and --.

Column 14,
Line 38, "surface," should read -- surface; --.

Signed and Sealed this

Sixth Day of September, 2005

JON W. DUDAS
*Director of the United States Patent and Trademark Office*